US005704592A

United States Patent [19]

White et al.

[11] Patent Number: 5,704,592

[45] Date of Patent: Jan. 6, 1998

[54] EXPANDABLE SAFETY BARRIER

[76] Inventors: Gary Ronald White, 6 Chantelle Rise; James Morish Polkinghorne, 10 Maxeen Drive, both of Greensborough, Victoria 3088, Australia

[21] Appl. No.: 561,248

[22] Filed: Nov. 21, 1995

[30] Foreign Application Priority Data

Sep. 7, 1995 [AU] Australia ..... PN 5260/95

[51] Int. Cl.[6] ..... E04H 17/00

[52] U.S. Cl. ..... 256/25; 256/24; 160/135

[58] Field of Search ..... 256/24, 25, 26; 160/135, 10, 136, 351, 46; 292/101, 135

[56] References Cited

U.S. PATENT DOCUMENTS

| | | | |
|---|---|---|---|
| 239,079 | 3/1881 | Bailey . | |
| 936,812 | 10/1909 | Robinson | 160/136 |
| 938,131 | 10/1909 | Dutschke | 292/101 |
| 1,276,100 | 8/1918 | Niznik . | |
| 1,498,633 | 6/1924 | Lewis . | |
| 1,741,323 | 12/1929 | Lufkin | 160/135 X |
| 2,221,357 | 11/1940 | Moore . | |
| 2,648,761 | 8/1953 | Shamel | 160/135 |
| 2,702,866 | 2/1955 | Anderson | 256/25 |
| 2,892,492 | 6/1959 | Jackoboice . | |
| 3,145,766 | 8/1964 | Wickham et al. . | |
| 3,605,851 | 9/1971 | Miles et al. | 160/135 |
| 3,767,167 | 10/1973 | Rasmussen | 256/24 X |
| 3,910,560 | 10/1975 | Goetz | 256/24 |
| 5,054,507 | 10/1991 | Sparks | 160/135 X |
| 5,364,050 | 11/1994 | Smith . | |

FOREIGN PATENT DOCUMENTS

| | | |
|---|---|---|
| 1203328 | 1/1960 | France . |
| 810761 | 8/1951 | Germany . |
| 302453 | 1/1929 | United Kingdom . |
| 685172 | 12/1952 | United Kingdom . |
| 767365 | 1/1957 | United Kingdom . |
| 2062051 | 5/1981 | United Kingdom . |
| 2151285 | 7/1985 | United Kingdom . |

*Primary Examiner*—Anthony Knight

*Attorney, Agent, or Firm*—Polster, Lieder, Woodruff & Lucchesi

[57] ABSTRACT

An expandable, collapsible barrier includes first and second endposts connected by an expandable, collapsible lattice structure. The barrier is provided with a handle mounted to one of the endposts and a handle receiving tube mounted to the other of the endposts. The handle receiving tube can receive the handle of a second barrier to hingedly interconnect two barriers. A latch bar is pivotally mounted to one of the end posts and a sleeve is provided on the other endpost. The latch bar and sleeve cooperated to lock the barrier in a collapsed position. When in the collapsed position, the barrier can be carried by the handle. Mounting brackets are provided for placing flags, lamps, and signboards on the barrier. The signboard bracket enables the signboard to be level at all stages of expansion of the barrier without the need to adjust the signboard.

18 Claims, 4 Drawing Sheets

EXPANDABLE SAFETY BARRIER

BACKGROUND OF THE INVENTION

This invention relates generally to expandable safety barriers, for example of the type employed to mark out a ground or floor area in which there is a safety hazard or in which maintenance or repair work is being carried out. The invention has application to barriers for both outdoor and indoor use and is particularly usefully applied to safety barriers having multiple hingedly coupled slats in a lattice structure which is expandable in a scissors action.

While temporary safety barriers of various kinds have been a familiar sight at outdoor work locations for many years, to delineate an area against vehicle or personal entry, it is believed that the fastest growing demand for such barriers lies in indoor applications, for example in shopping malls, sporting and other public venues, and generally in association with building maintenance.

Safety barriers of the lattice type are described, for example in British patents 302453 and 767365 and in published British patent applications 2062051 and 2151285. German patent specification 3834973 discloses another construction in which the barrier folds up concertina fashion in the horizontal plane rather than in a scissors action in the vertical plane. It is an object of the invention to provide a number of improvements in expandable safety barriers which enhance the versatility and/or handling of such barriers for a variety of applications.

SUMMARY OF THE INVENTION

The invention accordingly provides, in a first aspect, an expandable safety barrier including a plurality of hingedly interconnected elements arranged so that the barrier may be expanded out from a compact collapsed condition to a selectable operational condition, handle means for carrying the barrier in its compact collapsed condition, and latch means selectively positionable in a latching condition for maintaining the compact collapsed condition, which handle means and latch means are arranged so that the latch means is biased to maintain its latching condition as the collapsed barrier is picked up and carried by the handle means.

In a second aspect, the invention provides an expandable safety barrier including a plurality of hingedly interconnected elements arranged so that the barrier may be expanded out from a compact collapsed condition to a selectable operational condition, handle means at one end of the barrier for carrying the barrier in its compact collapsed condition, and complementary means at another end of the barrier cooperable with a similar handle means of another barrier for interconnecting the barriers together when extended, whereby to form a longer barrier assembly.

The invention still further provides, in a third aspect, an expandable safety barrier including a plurality of hingedly interconnected elements arranged so that the barrier may be expanded out from a compact collapsed condition to a selectable operational condition, and further including at least two laterally elongate base units for the barrier which are selectively detachable therefrom for variation of the orientation of their longitudinal dimension.

A preferred embodiment of expandable safety barrier includes two or three of these aspects of the invention.

The plurality of hingedly interconnected elements preferably includes a multiplicity of slats which are hingedly interconnected in a lattice structure so that the barrier expands and contracts in a scissors action. Each slat is preferably hinged adjacent its respective ends to a respective other slat and at its center to a further slat intermediate the respective other slats. The barrier preferably further includes at least two uprights defining end posts of the barrier and to each of which two end slats of the lattice structure are hinged. The hinged connection of at least one slat at each end is preferably vertically translatable as the barrier is expanded or contracted between its collapsed and operational conditions.

In the first aspect, the latch means is preferably an elongate latch bar pivotally mounted on or with respect to one of the uprights and having a slot for engaging a complementary projection which is fixed to or with respect to the other upright. For example, this latch bar may bridge the upper ends of the uprights in its latching condition. The latch bar may be biased to the latching condition by being offset from the location of the handle means and by forming the slot at an angle so that when the barrier is held by handle means associated with the first upright, the slot extends obliquely upwardly from a projection fixed to or with respect to the other upright.

The handle means preferably includes an angled rod with a free end and having two arms, one fixed to a respective upright and the other extending generally parallel to that upright. The cooperable means by which it may be engaged may then be a complementary sleeve or other female member on the other upright. The handle may include a hole formed near the free end of the handle and which is exposed beneath the cooperable member when the handle is received in the cooperable member. The hole is sized to accept a lock, such as a Pad lock, to prevent two connected barriers from being separated.

Each selectively detachable base unit in the third aspect of the invention is preferably generally in the form of an inverted T including a stem which telescopically engages with a respective upright. Thumbscrew means is preferably provided for detachably locking the base unit in position.

BRIEF DESCRIPTION OF THE DRAWINGS

The invention will now be further described, by way of example only, with reference to the accompanying drawings, in which.

DESCRIPTION OF THE PREFERRED EMBODIMENT

Figure 1:
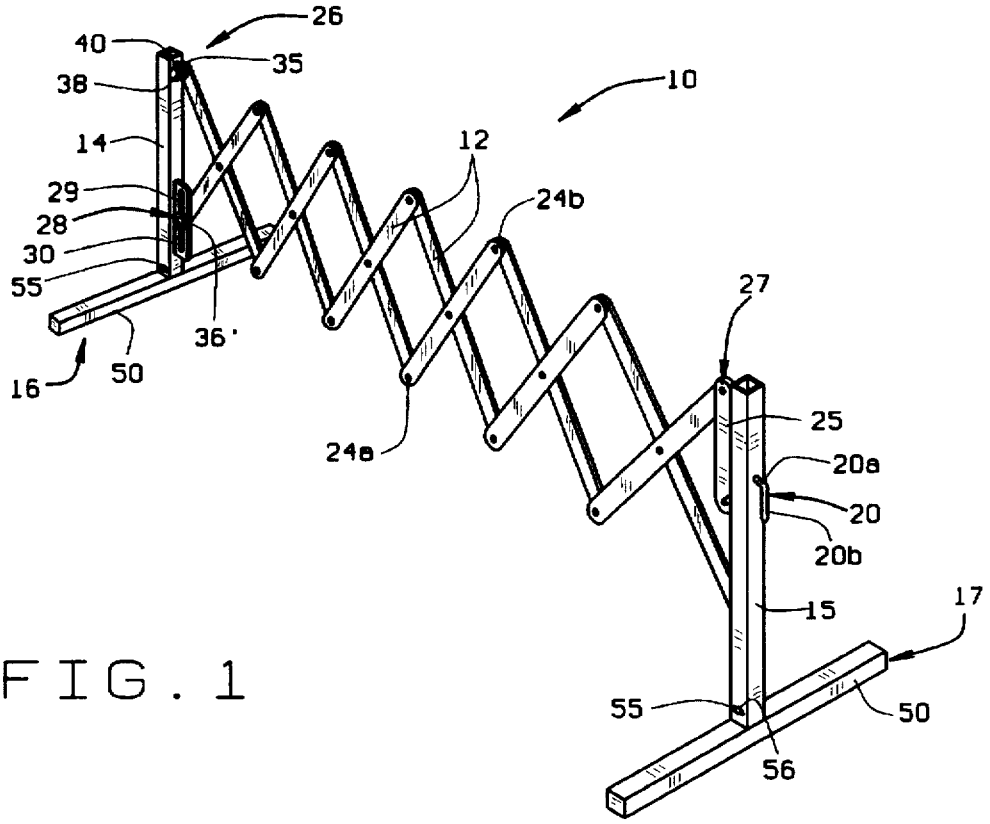
FIG. 1 is a perspective view of an expandable safety barrier according to an embodiment of the invention, shown in a partially expanded operational condition.

The illustrated expandable safety barrier 10 includes a multiplicity of hingedly interconnected elements in the form of slats 12 which define a barrier structure between a pair of square tubular uprights which form respective end posts 14, 15. Each end post 14, 15 has a detachable base unit 16, 17. One end post, 15, is fitted with a handle 20 and with a latch bar 25.

Slats 12 are hingedly interconnected in the fashion of a scissors action lattice structure. Each slat is hingedly pinned adjacent each end at 24*a*, 24*b* to the ends of respective other slats and at its center point 22 to the center of a further slat which lies intermediate those other slats. In effect, there are then two overlaid zig-zagging sets of slats. At each end, one slat is pivoted at 26, 27 to a fixed pin mounted to a bracket 35, 35' welded at the top of post 14, 15. The other end slat has a sliding pivot 28 which moves along a slot 29 in a flange bracket 30 welded to and extending along the inside face of post 14, 15.

Figure 2:
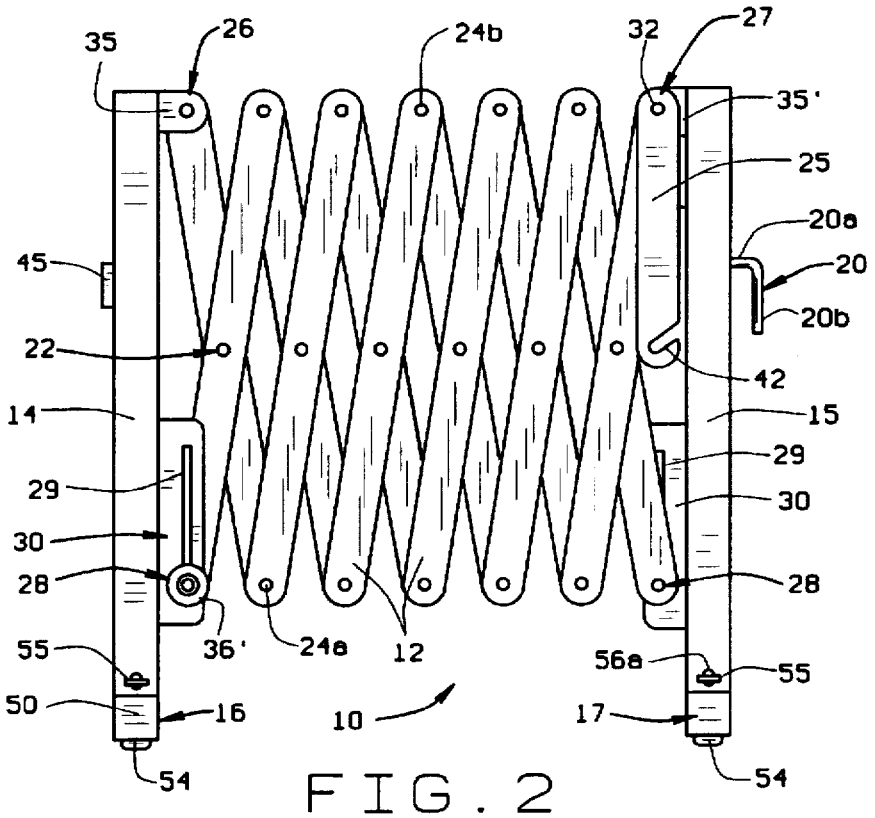
FIG. 2 is a front elevational view of the barrier shown in a slightly expanded condition.

It will be appreciated that the barrier may readily be expanded out from a compact collapsed condition (FIG. 3) in which the edges of slats 12 abut, and any selectable operational condition as the slats pivot further outwardly (FIGS. 1 & 2). The maximum extension is reached when sliding pivots 28 reach the tops of slots 29.

Figure 4:
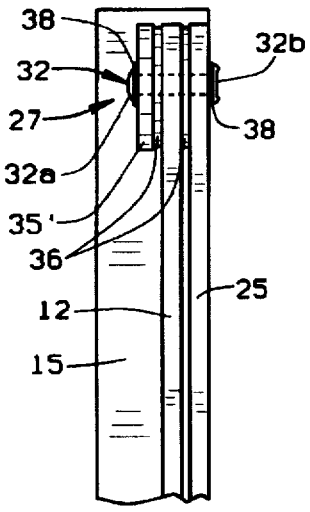
FIG. 4 and FIG. 5 are fragmentary end elevational views depicting two of the hinged connections.

The hinge pin structure 27 is depicted in FIG. 4. The hinge pin is a round-headed semi-tube rivet 32 of zinc-plated mild steel. Respective slat 12 is separated from the bracket 35 by a ring spacer 36 of high density polyethylene, and the latch bar 25 is similarly separated from the slat. Suitable washers 38 are located adjacent the head 32*a* of the rivet and the upset end 32*b*.

Figure 5:
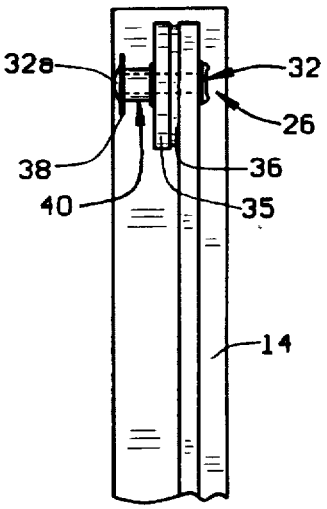

The hinge assembly 26 is illustrated in FIG. 5 and is generally similar to hinge assembly 27 save that, instead of the latch bar, the rivet carries a stainless steel sleeve 40 dimensioned to neatly slidably engage in an angled slot 42 adjacent the free end of latch bar 25. The assembly is latched in its fully collapsed compact condition (FIG. 3) by pivoting latch bar 25 up and engaging slot 42 onto sleeve 40.

The various hinges 22, 24*a*, 24*b*, between the slats are of a similar structure except that they need shorter rivets and of course have only one polyethylene spacer separating the slats. Sliding pivots 28 also include similar rivets but in these cases there are spacers 36' to both sides of the bracket plate 30. It will also be appreciated, particularly from FIG. 2, that the planes of brackets 30, 35 differ with respect to the two planes of slats and that the two sliding slats are on opposite sides of plate brackets 30.

Figure 6:
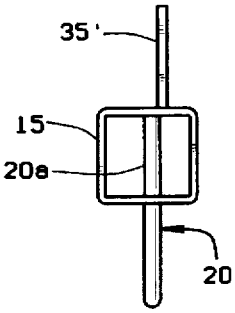
FIG. 6 is a top plan view of an upright of the barrier.

Handle 20 consists of a simple right-angle rod. One arm 20*a* projects at right angles through the outer side face of end post 15 and abuts the inside of the opposite face being welded to both (FIG. 6). The orientation is such that the other arm 20*b* then extends downwardly parallel to and spaced from the post 15. The other end post 14 carries a female counterpart to this handle 20 in the form of a simple complementary tube 45 welded in essentially aligned position to the outer end face of post 14 at a height to receive the arm 20*b* of the handle 20 of a second barrier so that the two are rotatably interengaged together to form a larger barrier assembly.

Handle 20 may alternatively, for example, be an inverted U, with one arm welded against and parallel to end post 15.

Figure 3:
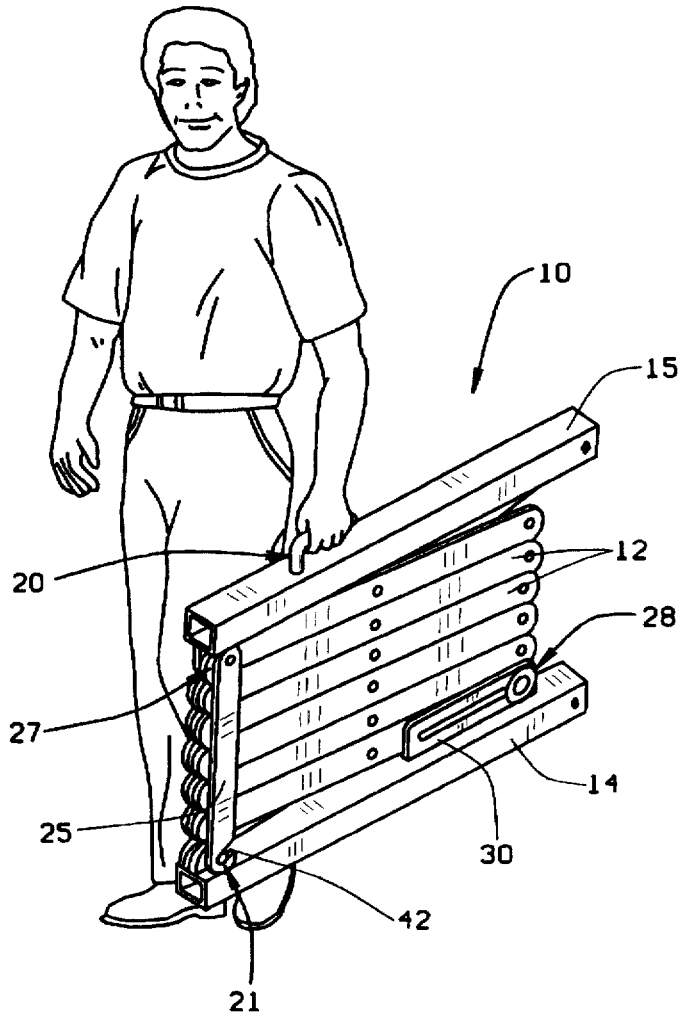
FIG. 3 the fully collapsed and latched barrier being carried by a user.

The projecting arm 20*a* of handle 20 is located at a position about a quarter of a length of the post from the top of the post. The collapsed and latched barrier is intended to be carried by grasping the other arm 20*b* of the handle and swinging the assembly around for carrying the posts 14, 15 generally horizontal (FIG. 3). Because of the relative locations of handle 20 and the hinge axis of latch bar 25 on end post 15, if the latch bar is not fully engaged onto sleeve 40 of hinge 26, it will be relatively biased to do so, because handle arm 20*a* is towards the same end as hinge 27 but nevertheless displaced from the hinge. Moreover, once the beam is in the carrying position, the latch bar is biased to maintain engagement and the security of the latching is further enhanced by the manner in which the slot 42 then extends outwardly and upwardly from the rivet and sleeve 40 of hinge 26. This safety feature is very useful because, in order to make the object generally versatile and stable, end posts 14, 15 would typically be formed in galvanized mild square tubular sleeve, and the slats in aluminum. The unit, while quite comfortable to carry, would thus be relatively heavy and it would be undesirable for the latch bar to disengage and the post 14 to drop onto a carrier's feet.

Figure 7:
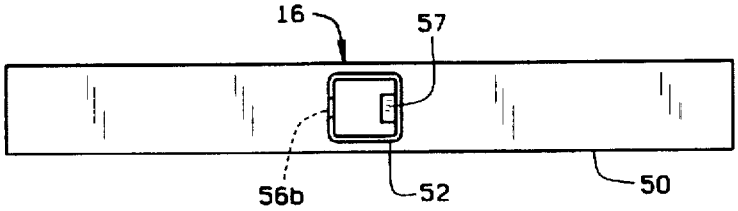
FIG. 7 a plan view of one of the base units.

The utility of the barrier is further enhanced by the detachable base units 16, 17. These are identical and comprise (FIG. 7) a base 50 of galvanized mild steel square tube and a stem 52 dimensioned to telescopically engage within either of posts 14, 15. The stem 52 is also square tube and is welded to the base. The underside of the base is fitted with a pair of neoprene ground engaging pads 54 fastened with an appropriate rivet. Pads 54 may be replaced with rollers or wheels W (FIG. 8), to enable the barrier to be rolled about.

Each base unit is detachably fastened to its post by means of a thumbscrew 55 which passes through registering holes 56*a*, 56*b* in a side face of the post and in stem 52 to engage a nut 57 welded internally on the opposite side of the stem.

Stem 52 may alternatively be a rectangular channel, with nut 57 on the base web of the channel. This alternative would facilitate welding of the nut 57.

It will be appreciated that each base unit can be selectively aligned with its base 50, and therefore its longitudinal dimension, either parallel with the general plane of the barrier or at right angles to it. Alteration of this orientation may be particularly desirable where two of the barriers are linked together (e.g. by the handle and sleeve attachment) so that the barriers extend at an angle with respect to each other, for example generally at a right angle. In some instances, it may be satisfactory to detach and not reattach one of the base units at the linking end.

Figure 8:
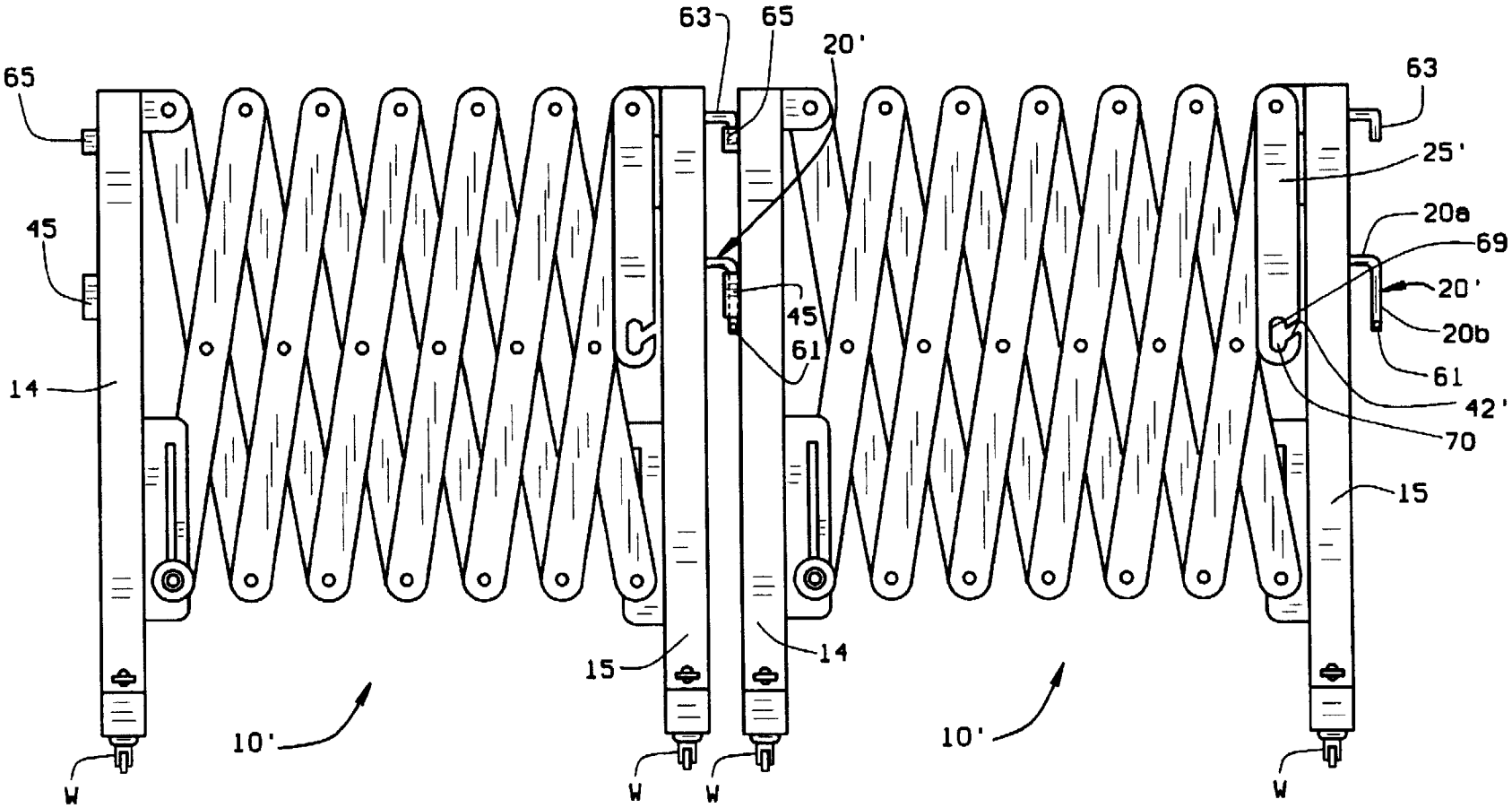
FIG. 8 is a front elevational view of two interconnected barriers, using an alternative embodiment of the barrier.

FIG. 8 shows two barriers 10' hingedly interconnected by the handle 20' of one barrier which is inserted into the tube 45 of the post 14 of the other barrier. The handle 20' in FIG. 8 is provided with a hole 61 sized to accept a standard padlock, such as a Master Lock® type padlock, to lock the two barriers together and prevent their separation. The post 15 may also be provided with a small L-bracket 63 secured to the post 15 above the handle 20'. The opposite end post 14 is provided with a corresponding tube 65. The L-bracket 63 of one barrier is received in the tube 65 of a second barrier, and together, define a second hinge point for the two barriers. Additional L-brackets and tubes can be added to provide for three or more hinge points. The use of two hinge points makes the axis of rotation between the two barriers more stable. The two interconnected barriers will have less of a tendency to pivot about a horizontal axis with respect to each other if there are two or more hinge points.

The barrier 10' also has a slightly different latch bar 25'. The latch bar 25' is provided with a slot 42' which is angled in the same manner as the slot 42 of latch bar 25. Latch bar 25', however, is provided with a second slot 69 which is parallel to the longitudinal axis of the latch bar 25' and which intersects slot 42'. The two slots 42' and 69 define a slot having a modified T-shape. When the barrier 10' is collapsed and the latch bar 25' is pivoted into place such that the slot 42' engaging the sleeve 40, the sleeve 40 will engage the transverse slot 69 when the barrier 10' is being carried by the handle 20'. When the sleeve 40 is engaged in the transverse slot 69, the spacer will be captured in an area 70 of the slot 69. Because the sleeve 40 will be captured, the possibility of the latch bar 42' from disengaging the sleeve 40 is reduced. This slot configuration thus will facilitate a more secure locking of the barrier in the collapsed position when the barrier is being carried (such as shown in FIG. 3).

The open upper ends of end posts 14, 15 may typically be closed by plastic end caps. These may advantageously be removable to allow the mounting of a range of accessories into the open upper ends of the end posts. Such accessories might include, for example, lamps and noticeboards.

The combination of steel tubular posts 14, 15 with stable base units 16, 17 and the hinge structure utilizing a rivet with a high-density polyethylene spacer and washers is found to facilitate very easy expansion of the barrier by simply pulling one post away from the other post. That other post remains stable and stationary as the barrier is pulled out to its maximum length.

Figure 9:
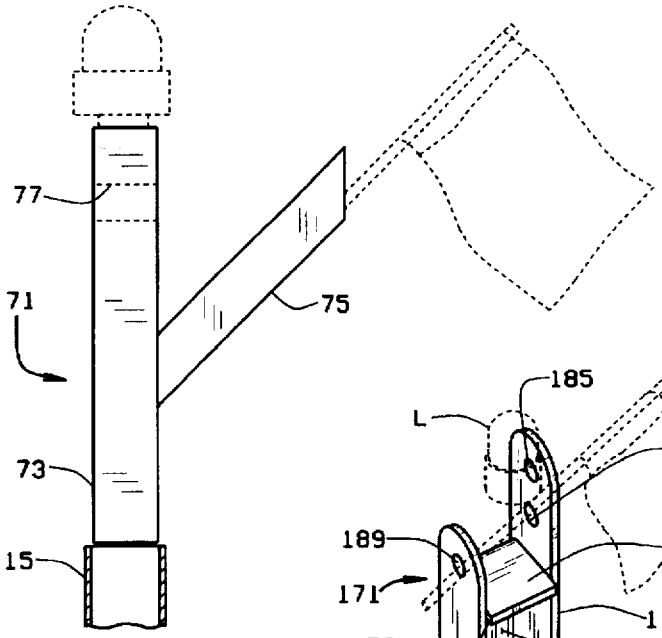
FIG. 9 exploded view of a combined flag and lamp bracket being inserted into an upright of the barrier.

A lamp and sign post bracket 71 is shown in FIG. 9. Bracket 71 includes a generally vertical tube 73 which is telescopically and removably received in the top of the end post 14,15, and extends vertically from the top of the end post 14,15. A second tube 75 is welded to tube 73 and extends upwardly and outwardly from tube 73, preferably at a 45° angle thereto. Tubes 73 and 75 are hollow and may be provided with a lamp (such as a flashing light) and a sign or flag (such as a "men working" flag). Preferably the lamp is placed in the top of tube 73 and the flag is inserted, via its pole, in the tube 75. Obviously, this arrangement can be altered. The tube 73 has an opening 77 therethrough which is sized to accept a bolt, pin or the like. The bolt or pin extends through the base or post of the lamp to secure the lamp to the tube. Tubes 73 and 75, like posts 14 and 15, are preferably square tubes.

Figure 12:
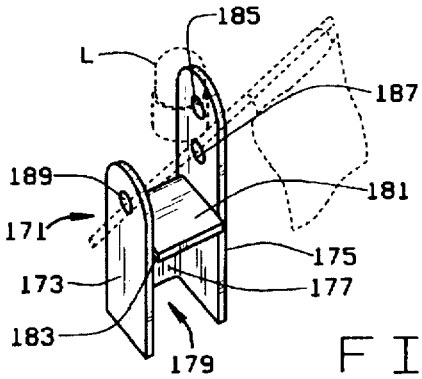
FIG. 12 is a perspective view of an alternative embodiment of the combined flag and lamp bracket.

An alternate lamp and flag bracket 171 is shown in FIG. 12. The bracket 171 has a left leg 173 and a right leg 175 joined by a back wall 177 to define a channel 179. A flap 181 extends between the legs 173 and 175 near the top of the left leg and extends from the back wall 177 to a point forward of the front of the legs to define a lip 183. The square defined by the legs 173 and 175 and the back wall 177 are sized to be telescopically received in the top of one of the endposts 14, 15 of the barrier. The lip 183 extends over the top of the endpost and forms a stop to prevent the bracket 171 from sliding too far into the endpost. The bracket 171 is preferably made from a single sheet of material that is folded into the formation shown. The bracket may be formed in other ways as well, for example by welding the various components together.

The right leg 175 includes two spaced apart holes 185 and 187 and the left leg includes a hole 189. The holes 189 and 187 are vertically spaced apart, and define an angle of about 45°. To secure a lamp L in the bracket 171, the lamp is positioned against the right leg 175 and a bolt is passed through the hole 185 and lamp to secure the lamp to the bracket. By tightening the bolt, the lamp will be secured against pivotal motion in the bracket. However, other or additional securing means, such as further holes or clamps may be used to secure the lamp in the bracket. To insert the flag in the bracket, the flag's pole is simply slid through the two holes 187 and 189, and is frictionally secured in place.

Figure 10:
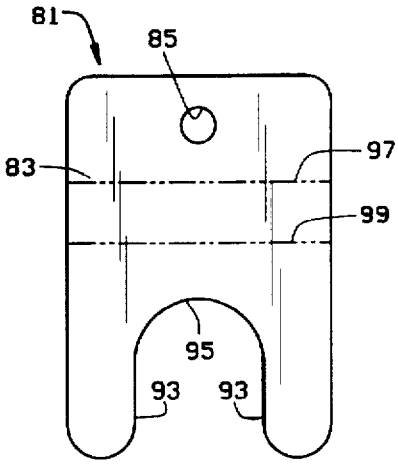
FIG. 10 is a front elevational view of a sign bracket which may be hung on the barrier.
Figure 11:
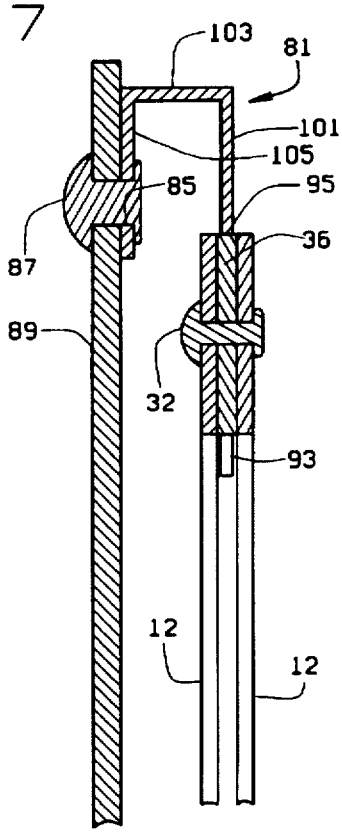
FIG. 11 is a cross-sectional view of the sign bracket, with a sign thereon, hung from the barrier.

A sign board bracket 81 is shown in FIGS. 10 and 11. Bracket 81 includes a body portion 83 having a hole 85 therein. Hole 85 is sized to accept a rivet, bolt, or the like 87 (FIG. 11) to secure a signboard 89 to the post. A pair of spaced apart legs 93 depend from body portion 83 and are connected by an arcuate edge 95. Edge 95 is shaped to match the curvature of the spacer 36 which separates the slats 12. The legs 93 are spaced apart a distance slightly more than the diameter of the spacer 36 so that the bracket 81 may pivot about the spacer. Between the hole 85 and the arcuate edge 95, the bracket includes a pair of fold lines 97, 99. As seen in FIG. 11, the bracket body 81 is folded about the fold lines 97 and 99 to form a generally U-shaped bracket. When folded, the bracket has a first vertical leg 101 which includes the bracket legs 93, a horizontal section 103 which extends forward over the barrier slats 12, and a second vertical leg 105 which includes the hole 85 and which is shorter than the first leg 101. The horizontal section 103 is sized such that the second leg 105 will be forward of the rivet 32 which passes through the slats 12 to hingedly connect the slats. The signboard 89 can then be flush mounted to the bracket leg 105. If the signboard were straight, rather than U-shaped as shown, then a spacer would be needed to space the sign from the rivet 32.

When the signboard 89, secured to the bracket 81, is placed on the barrier 10, the ability of the bracket 81 to pivot about the spacer 36 will substantially ensure that the sign will be level at all stages of expansion of the barrier, and will not have to be adjusted if the extent of expansion is change. Stated differently, the signboard 89 will remain level and will not require adjustment when the barrier is expanded or contracted from a present position to a new position.

Throughout this specification and the claims which follow, unless the context requires otherwise, the word "comprise", or variations such as "comprises" or "comprising", will be understood to imply the inclusion of a stated integer or group of integers but not the exclusion of any other integer or group of integers.

The described arrangement has been advanced merely by way of explanation and many modifications may be made thereto without departing from the spirit and scope of the invention which includes every novel feature and combination of novel features herein disclosed. For example, although certain materials have been disclosed as preferred for the various parts of the barrier, any suitable material can be used.

We claim:

1. An expandable, collapsible barrier, said barrier being selectively movable between a collapsed position, and a selectively expanded position: the barrier including:

a first end post, a second end post, and an expandable, collapsible lattice structure extending between said first and second end posts, said lattice structure comprising a plurality of slats which are hingedly connected together to define two overlaid zig-zagging sets of slats, said sets of slats being separated from each other by a spacer; said two overlaid zig-zagging sets of slats each including two end slats defining an upper slat and a lower slat, said upper slat being hingedly connected to a respective end post near a top of said end post and said lower slat being hingedly connected to a sliding pivot near a bottom of said end post;

a handle mounted to one of said first and second endposts, said handle including a first part extending outwardly of said end post and a second part depending from said first part and extending parallel to, and spaced from said end post, said handle second part having a free end;

a handle receiving member mounted to the other of said first and second end posts, said handle receiving member positioned on said other of said end posts to receive the handle of a second barrier to hingedly interconnect two barriers, said barrier being sized such that it can be carried by holding onto said handle when said barrier is in said collapsed position;

a latch bar pivotally mounted to one of said first and second end posts and a sleeve extending from the other of said first and second end posts; said latch bar having a slot which engages said sleeve to secure said barrier in said collapsed position;

a base for each of said end posts; and a signboard mounting bracket for mounting a signboard on said barrier, said mounting bracket including a body portion to which said signboard is secured and a pair of spaced apart legs depending from said body portion; said legs being spaced apart a distance slightly greater than the diameter of said spacer and having an arcuate surface extending between said legs, said arcuate surface having a curvature substantially equal to the curvature of said spacer whereby said bracket, and hence said signboard, may pivot with respect to said spacer; said signboard remaining substantially level at all stages of expansion of said barrier without need to substantially adjust said signboard or bracket.

2. The barrier of claim 1 including a plate defining a generally vertical slot mounted to said end posts near a bottom thereof, said sliding pivot being slidable in said plate slot.

3. The barrier of claim 1 including a hole formed in a free end of said handle, said hole being sized to accept the shank of a lock to lock two barriers together in a hinged relationship when the handle of a first barrier is received in the handle receiving member of a second barrier.

4. The barrier of claim 1 wherein said latch bar is pivotally mounted to said one of said endposts and to the top slat, said sleeve extending from the top slat of the other of said endposts, said latch bar slot being offset from the horizontal when said locking arm hangs vertically along said end post.

5. The barrier of claim 4 wherein said latch bar includes a second slot which crosses over and communicates with said first slot of said latch bar, said second slot being generally parallel to a longitudinal axis of said latch bar, wherein, when said barrier is in its collapsed position and being carried by said handle, said sleeve drops into said second slot to be engaged by said second slot.

6. The barrier of claim 1 wherein said hingedly connected slats are connected by a pin and spaced apart from each other by a polyethylene spacer.

7. The barrier of claim 1 wherein said signboard mounting bracket is generally U-shaped, said signboard bracket having a first vertical leg which includes said bracket legs, a generally horizontal portion extending from said first vertical leg, and a second vertical leg depending from said horizontal potion such that said second vertical leg is spaced from said first vertical leg; said signboard being secured to said second vertical leg; said horizontal portion being sized to space said signboard forward of a fastener which hingedly connects said slats of said lattice structure.

8. The barrier of claim 1 wherein said endposts are comprised of tubing; each said base including a ground engaging member and a tubular boss extending up from said ground engaging member; said tubular boss being telescopically received in said endposts, the barrier further including a bolt which threadedly extends through said base boss and at least partially though said end post to secure said base to said endpost; said base boss including a hole on one side and a threaded fastener secured to an opposite side, said bolt being threaded into said threaded fastener.

9. The barrier of claim 8 wherein said base includes one of a plurality of ground engaging pads and ground engaging rollers.

10. The barrier of claim 1 including a hinge mechanism for hingedly connecting two barriers together, said hinge mechanism comprising said handle and said handle receiving member.

11. The barrier of claim 10 wherein the hinge mechanism further comprises at least one L-bracket secured one of said end posts and a tube secured to the other of said end posts which receives a free end of said L-bracket, said L-bracket being mounted to the same end post to which said handle is mounted.

12. The barrier of claim 1 wherein the latch bar includes a second slot which crosses over and communicates with said first slot of said latch bar; said second slot being generally parallel to the longitudinal axis of the latch bar.

13. An expandable, collapsible barrier, said barrier being selectively movable between a collapsed position, and a selectively expanded position; the barrier including:

a first end post, a second end post, and an expandable, collapsible lattice structure extending between said first and second end posts, said lattice structure comprising a plurality of slats which are hingedly connected together to define two overlaid zig-zagging sets of slats, said two overlaid zig-zagging sets of slats each including two end slats defining an upper slat and a lower slat, said upper slat being hingedly connected to a respective end post near a top of said end post and said lower slat being hingedly connected to a sliding pivot near a bottom of said end post;

a handle mounted to one of said first and second endposts, said handle including a first part extending outwardly of said end post and a second part depending from said first part and extending parallel to, and spaced from said end post, said handle second part having a free end;

a handle receiving member mounted to the other of said first and second end posts, said handle receiving member positioned on said other of said end posts to receive the handle of a second barrier to hingedly interconnect two barriers, said barrier being sized such that it can be carried by holding onto said handle when said barrier is in said collapsed position:

a latch bar pivotally mounted to one of said first and second end posts and a sleeve extending from the other of said first and second end posts; said latch bar having a slot which engages said sleeve to secure said barrier in said collapsed position:

a base for each of said end posts; and a lamp and flag mounting bracket for mounting one or both of a lamp and a flag on said barrier, said lamp and flag bracket including a first tube and a second tube extending from said first tube; said first tube being telescopically received in one of said end posts to extend above said end post said first tube receiving one of said lamp and said flag and said second tube receiving the other of said lamp and said flag.

14. An expandable, collapsible barrier, said barrier being selectively movable between a collapsed position, and a selectively expanded position; the barrier including:

a first end post, a second end post, and an expandable, collapsible lattice structure extending between said first and second end posts, said lattice structure comprising a plurality of slats which are hingedly connected together to define two overlaid zig-zagging sets of slats, said two overlaid zig-zagging sets of slats each including two end slats defining an upper slat and a lower slat, said upper slat being hingedly connected to a respective end post near a top of said end post and said lower slat being hingedly connected to a sliding pivot near a bottom of said end post;

a handle mounted to one of said first and second endposts, said handle including a first part extending outwardly of said end post and a second part depending from said first part and extending parallel to, and spaced from said end post, said handle second part having a free end;

a handle receiving member mounted to the other of said first and second end posts, said handle receiving member positioned on said other of said end posts to receive the handle of a second barrier to hingedly interconnect two barriers, said barrier being sized such that it can be carried by holding onto said handle when said barrier is in said collapsed position;

a latch bar pivotally mounted to one of said first and second end posts and a sleeve extending from the other of said first and second end posts; said latch bar having a slot which engages said sleeve to secure said barrier in said collapsed position;

a base for each of said end posts; and a lamp and flag mounting bracket for mounting one or both of a lamp and a flag to said barrier, said lamp and flag mounting bracket including first and second spaced apart legs, a back wall extending between said legs, and a flap extending between said legs from said back wall to a point forward of said legs to define a lip; said legs and back wall defining a channel sized to be telescopically received in said barrier end post, said lip acting as a stop; said first leg being shorter than said second leg; said first leg including a hole therein, said second leg including a lower hole and an upper hole; said lower hole of said second leg being vertically offset from said first leg hole; a lamp being secured to said second leg by a fastener extending through the upper hole of said second leg, a flag being mounted in said bracket by passing a pole of said flag through said lower hole of said second leg and said first leg hole.

15. In combination, an expandable, collapsible barrier and at least one accessory for mounting a signboard, a flag mounted to a flag pole, a lamp, or combinations thereof to said barrier; said barrier including:

a first hollow end post, a second hollow end post, and an expandable, collapsible lattice structure extending between said first and second end posts; said lattice structure being selectively movable between a collapsed position and a selectively expanded position, said lattice structure comprising a plurality of hingedly connected slats, a majority of said slats being hingedly connected at an upper end to a first slat, at a bottom end to a second slat, and at its center to a third slat intermediate said first and second slats, said first, second, and third slats being substantially parallel to each other; said slats defining two overlaid zig-zagging sets of slats; said hingedly connected slats being separated from each other by a polyethylene spacer and pivotally connected by a pin which extends through said two slats and said spacer;

said at least one accessory being chosen from a sign board bracket, a lamp and flag bracket, and combinations thereof;

said signboard bracket including a generally U-shaped body portion to which said signboard is securable, said body portion including a first vertical portion, a horizontal portion extending from a top of said first vertical portion, and a second vertical portion spaced from said first vertical portion and depending from said horizontal portion and to which said signboard is secured, pair of spaced apart legs depending from said body first vertical portion; said legs being spaced apart a distance slightly greater than the diameter of said spacer and having an arcuate surface extending between said legs, said arcuate surface having a curvature substantially equal to the curvature of said spacer whereby said bracket, and hence said signboard, may pivot with respect to said spacer; said signboard remaining substantially level at all stages of expansion of said barrier without need to substantially adjust said signboard or bracket.

16. The combination of claim 15 wherein the said lamp and flag bracket includes first and second spaced apart legs, a back wall extending between said legs, and a flap extending between said legs from said back wall to a point forward of said legs to define a lip; said legs and back wall defining a channel sized to be telescopically received in said barrier endpost, said lip defining a stop; said first leg being shorter than said second leg; said first leg including a hole therein, said second leg including a lower and an upper hole; said lower hole of said second leg holes being vertically offset from said first leg hole; a lamp being secured to said second leg by a fastener extending through the upper holes, a flag being mounted in said bracket by passing a pole of said flag through said lower hole of said and said first leg hole.

17. The combination of claim 15 wherein said lamp and flag bracket includes a first tube which is telescopically received in one of said end posts and extends above said end post and a second tube which extends from said first tube, said first tube receiving a lamp and said second tube receiving a flag pole.

18. The combination of claim 17 wherein said first tube of said lamp and flag bracket includes a hole in opposite sides thereof, said hole being spaced above said end post and being capable of receiving a pin to secure said lamp to said end post.

* * * * *